United States Patent [19]

Kemp

[11] 4,222,429

[45] Sep. 16, 1980

[54] FOUNDRY PROCESS INCLUDING HEAT TREATING OF PRODUCED CASTINGS IN FORMATION SAND

[75] Inventor: Willard E. Kemp, Houston, Tex.

[73] Assignee: Foundry Management, Inc., Houston, Tex.

[21] Appl. No.: 45,841

[22] Filed: Jun. 5, 1979

[51] Int. Cl.[2] ..... B22D 27/04; B22D 27/16; C21D 9/00

[52] U.S. Cl. ..... 164/34; 148/3; 164/65; 164/66; 164/76

[58] Field of Search ..... 164/34, 65, 66, 76, 164/253, 255; 148/3; 34/10, 57 A

[56] References Cited

U.S. PATENT DOCUMENTS

| | | | |
|---|---|---|---|
| 2,830,343 | 4/1958 | Shroyer | 164/34 |
| 2,985,929 | 5/1961 | Carter | 164/122 |
| 3,157,924 | 11/1964 | Smith | 164/34 |
| 3,222,738 | 12/1965 | Carter | 164/34 |
| 3,295,175 | 1/1967 | Krzyzanowski | 164/246 |
| 3,302,256 | 2/1967 | Wittmoser | 164/246 |
| 3,314,116 | 4/1967 | Wittmoser et al. | 164/246 |
| 3,339,620 | 9/1967 | Krzyzanowski et al. | 164/246 |
| 3,350,915 | 11/1967 | Staffin | 34/10 |
| 3,410,942 | 11/1968 | Bayer | 164/246 X |
| 3,452,806 | 7/1969 | Wittmoser | 164/246 |
| 3,496,989 | 2/1970 | Paoli | 164/30 |
| 3,498,360 | 3/1970 | Wittmoser et al. | 164/47 |
| 3,498,365 | 3/1970 | Wittmoser | 164/349 |
| 3,557,867 | 6/1971 | Krzyzanowski | 164/255 |
| 3,572,421 | 3/1971 | Mezey et al. | 164/237 |
| 3,581,802 | 6/1971 | Krzyzanowski | 164/34 |
| 3,619,866 | 11/1971 | Hofmann et al. | 164/34 X |
| 3,620,286 | 11/1971 | Hofmann | 164/34 |
| 3,654,987 | 4/1972 | Wittmoser et al. | 164/369 |
| 3,678,989 | 7/1972 | Krzyzanowski | 164/246 |
| 3,694,924 | 10/1972 | Staffin et al. | 34/10 |
| 3,741,281 | 6/1973 | Hauser-Lienhard | 164/253 |
| 3,766,969 | 10/1973 | Mezey et al. | 164/383 |
| 3,842,899 | 10/1974 | Hauser-Lienhard | 164/253 |
| 3,861,454 | 1/1975 | Mezey | 164/93 |
| 4,068,389 | 1/1978 | Staffin et al. | 34/57 A |

FOREIGN PATENT DOCUMENTS 1537486 12/1978 United Kingdom .

OTHER PUBLICATIONS

Industrial Heating, The Journal of Thermal Technology, Sep. 1978, "Design Aspects of Fluidized Bed Furnaces and Their Applicability", pp. 32–35.

Steel Casting Research and Trade Asso., No. 41, Jun. 1978, "Potential Improvements in Shell Mould Casting Practice", D. Bish et al.

*Primary Examiner*—Robert D. Baldwin

*Attorney, Agent, or Firm*—Frank S. Vaden

[57] ABSTRACT

Castings are produced in a bed of production sand susceptible to both fluidizing and vacuumizing. The use of a vacuum at the time the molten metal is poured permits the use of thin shell molds made around styrene patterns, the vacuum maintaining mold shape and drawing out gases produced by the vaporizing pattern and otherwise. The produced casting is rapidly cooled in the bed while it is fluidized, the fluidized sand achieving good heat conduction. The casting is then heat stabilized while the bed is defluidized, the bed then becoming a good insulator. An austempering curve can be followed, thereby having the effect of heat treating in the same bed as used for casting production.

28 Claims, 2 Drawing Figures

FOUNDRY PROCESS INCLUDING HEAT TREATING OF PRODUCED CASTINGS IN FORMATION SAND

BACKGROUND OF THE INVENTION

1. Field of the Invention

This invention pertains to the heat treatment of metal alloy castings and more specifically to the heat treatment of such castings in a fluidized bed used in conjunction with the making of the castings.

2. Description of the Prior Art

The basic operations of a foundry are molding, pouring, cooling, mold removal, sand reclamation, heat treating of the casting, and further heat treating and cooling for tempering purposes. In normal foundries, each operation is accomplished at a separate work station with considerable movement of material and equipment between each step.

Molding comprises the forming of sand or other granular material around a pattern to form two half-impressions of the part to be made. The box containing the sand impressions is then moved to a station where molten metal is poured into the cavity through a port in the sand. Generally, metal is melted in a furnace and then poured into a ladle which is then carried to the location where several molds are arranged for pouring.

The molds are then cooled and moved to a shake-out area where vibration or physical means is used to break and expel the sand from around the casting or castings. Each casting is then cleaned by blasting or other techniques and extraneous metal is removed.

The rough castings are then moved to a furnace where they are heated to a temperature of around 1600° F. After a period of time, usually half an hour or so, a casting is removed and rapidly cooled with air, oil or water.

The casting is then heated again to a lower temperature, perhaps 1100° F., and held for a time to temper and to provide satisfactory material properties.

The casting must then usually be blasted again to clean it and remove scale build-up during the high temperature operations.

Between each of the foregoing steps, there is considerable manpower necessary to move castings from one station to another. In a typical foundry where producing heat treated steel castings is accomplished by intermediate production runs, the amount of man hours necessary to produce castings is about 100 man hours per ton.

The process described herein, which can be characterized as a heat treating process in the environment of a foundry for making the castings, results in a savings of man hours required to produce the casting of about 80%. This is because ordinarily all operations are performed while the casting is still in the original sand mold.

Therefore, it is a feature of this invention to provide an improved heat treating environment for a metal alloy casting which is the sand bed, capable of being fluidized, used in the foundry production of the casting.

It is another feature of the present invention to provide an improved process of producing and heat treating a metal alloy casting, wherein the bed is alternately subjected to fluidizing and vacuumizing, the fluidizing advantageously providing a heat treating environment and the vacuumizing advantageously making the metallic molten flow more efficient while also cleansing the atmosphere of unwanted fumes and particle debris and supporting efficiently produced thin shell molds that can be used in such production.

SUMMARY OF THE INVENTION

A foundry process, including heat treating, is accomplished by having a sand bed for the casting which is combined with means for fluidizing the bed. The bed has placed into it one or more thin shell molds made preferably of sand and resin binders. The mold is preferably made by first making a pattern out of styrene. Placement of the pattern and mold is accomplished by fluidizing the bed and pressing the pattern into position. A vacuum is then drawn on the bed to set the mold and to keep its shape. Molten metal is then poured into the mold, vaporizing the pattern, the flow of the metal enhanced by the vacuum. The vacuum is increased during the pouring since excess gas is liberated as the styrene pattern vaporizes. The vacuum keeps the liberated gas from distorting the mold even at the instance of pouring.

The bed is placed at rest while the casting cools somewhat. Then the bed is fluidized and defluidized alternately to achieve a quenching and heat stabilizing effect in the casting according to a desirable austempering curve. Heating can be added, if desired, to achieve other desirable heat treating of the casting. Finally, the bed is fluidized to effect easy removal of the casting from the bed.

BRIEF DESCRIPTION OF THE DRAWINGS

So that manner in which the above-recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the appended drawings illustrate only a typical embodiment of the invention and are therefore not to be considered limiting of its scope, for the invention may admit to other equally effective embodiments.

IN THE DRAWINGS

Figure 1:
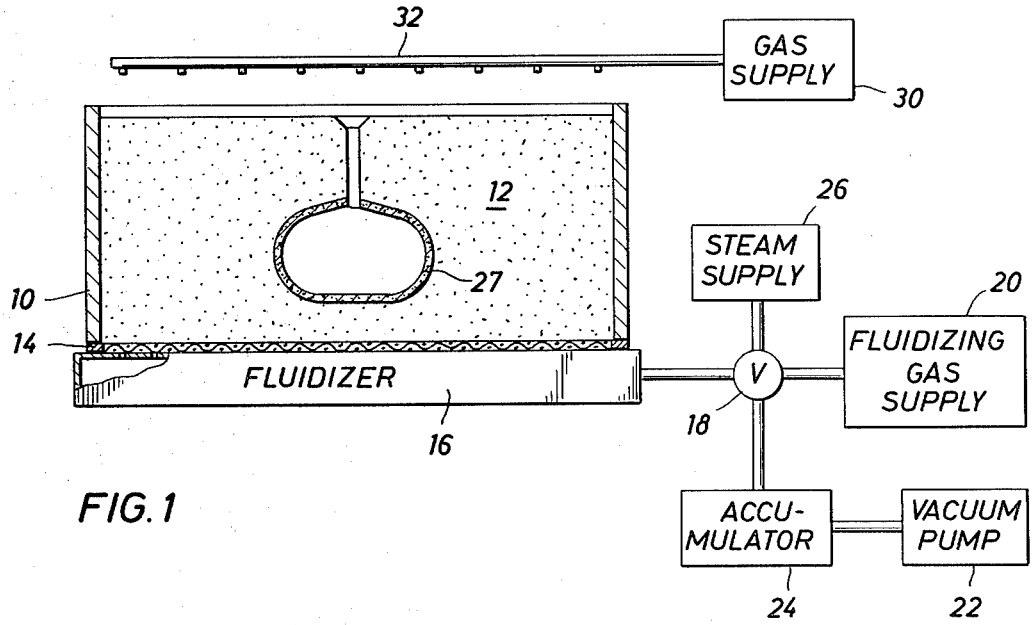

FIG. 1 is a schematic diagram of a preferred embodiment of the present invention.

Figure 2:
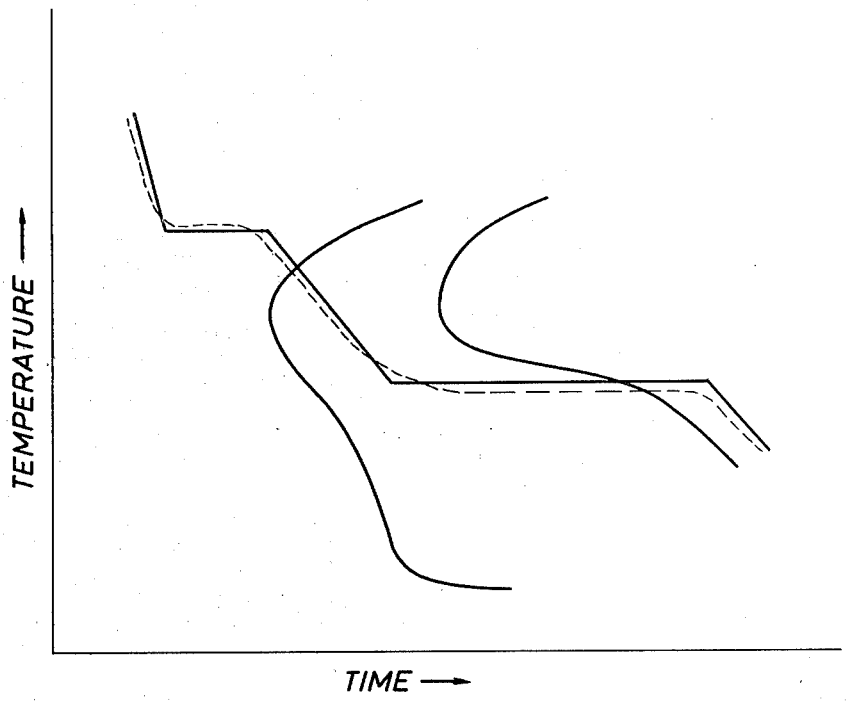

FIG. 2 is a time temperature transformation curve of a typical alloy casting which is heat treated in accordance with the present invention.

DESCRIPTION OF THE PREFERRED EMBODIMENT

In the preferred foundry process which is described hereinafter, thin shell molds of sand and resin are produced, the resins forming binders for holding the sand mold shapes. The thinness of the mold is made possible because the shells are not required to support a casting or to withstand the heat of the casting by itself. The sand is compacted and held in position by a vacuum which is drawn on the molds even up to and though the process of pouring the molten metal therein.

Typically a mold will be positioned in the bed of sand so that it is completely surrounded by the sand. A typical box of sand is six feet long by three feet high by three feet deep. As may be seen by a description of the process, a car on an assembly line holding the box and having the fluidizer as hereinafter described can be moved to the furnace where the molten metal is directly poured without going through the usual interim steps of pouring first into a ladle and then ladling into the mold.

Now referring to the drawings and first to FIG. 1, a box-type container 10 is shown which is filled with granular material 12, such as sand and binder normally employed in foundries for casting alloy castings. The bottom of the container is enclosed with fine mesh screen 14 through which air is capable of flowing, but through which sand will not unduly sift. The container is placed on or over a fluidizer 16, which is topped off by a distributor plate or permeable membrane available in the prior art for providing a pressure differential to sand bed 12.

The fluidizer is attached through valve 18 to a fluidizing gas supply 20, which may be an air compressor or a supply of some other gas, as more fully explained hereinafter. Valve 18 also provides connection to vacuum pump 22, preferably through accumulator 24. Ordinarily, fluidizing a sand bed to the necessary degree for the operations called for in the present invention requires maintaining a pressure differential through the bed of about 100 feet per minute for 30 mesh sand and of only about 3–30 feet per minute for sand in the nominal 80–120 mesh range. The accumulator action is explained more fully below.

A thin porous shell mold 26 and core assembly is produced of sand resin binders for determining the shape of the casting. The mold is the reverse image of the finally produced casting. As is explained hereinafter, the thin shell mold can be quite thin and does not have to be self- supporting. Thin molds reduce the amount of mold sand and binder required, improve outgassing, as is more fully explained below, and reduce the amount of foreign particles in the bed that need to be reclaimed.

One convenient way of making a proper mold is to first make a pattern out of styrofoam or other similar product, styrene or otherwise. The pattern is in the shape of the final product. The pattern is then "washed" or coated to produce a mold with a thin, temperature-resistant, permeable material. The mold and pattern together are then placed into bed 12 while it is fluidized. It should be noted that a fluidized sand bed takes on many characteristics of a water mass and that it takes great force to submerge lightweight styrene patterns because of their buoyancy when compared with the sand acting like a fluid with a density of about 100 pounds per cubic foot. Several molds can be submerged into a common bed and arranged into a suitable formation for convenience of pouring and heat treatment. In one bed, it took a force somewhat greater than the weight of the finished casting, or about 800 pounds, to push six styrene patterns into a fluidized bed of sand.

Once the molds are in position, the fluidizing is suspended and the sand settles around and supports the molds (or the patterns and molds). In order to achieve proper placement and support and to assist compaction the bed may be vibrated by means not shown, if necessary, and a vacuum may be drawn on the bed via vacuum pump 22. Furthermore, to aid in establishing the vacuum, a plastic sheet or other cover can be placed over the top of the bed during the vacuum drawing operation.

With the molds in proper position and with a vacuum drawn on the bed, the molds are held in position and shape against the compacted sand. The molten metal is then poured into the molds to vaporize the styrene pattern (if present) and to fill the mold. The mold wash retains its shape while the mold is being filled by the vacuum pull, which also draws the vapor products down through the sand. The sand acts as an effective filter for the vapor as well as liberated particles. This particularly important when a styrene pattern is vaporized, although even when only a mold is employed, the vacuum draws off loose resins or other binder materials.

In addition to the above, employing a vacuum also aids in the flow of the molten metal. The use of vacuum accumulator 24 shown in the drawing makes it possible from a practical sense to increase the vacuum draw during the actual pouring of the metal. The first instant of pouring into the styrene results in a large amount of gas formation, which has heretofore created a problem in the use of styrene pattern molds. A conventionally sized vacuum pump can be economically provided to pull the gas off, but for a short period of time when the gas liberation is at its greatest, a pump having a capacity of about 500 cfm, sufficient for most of the operations described herein, is not large enough. That is, in order to pull off the surge of gas that is liberated, it is necessary to have a capacity of 2000 or 3000 cfm for a few seconds. Accumulator 24 provides this short term capacity.

Accumulator 24 is typically a 3000 cubic foot tank that is opened into the line leading to the mold through valving 18 at the time of pouring. The produces a great rush of air out of the mold for the few seconds necessary to compensate for the production of gases at the very time such compensation is needed. Therefore, the vacuum pulls off the combustion products as well as assisting the flow of metal and supporting the thin layer of mold wash as the styrene burns ahead of the metal flow.

After pouring, the vacuum on the bed is maintained while the metal casting cool and solidify to a level about the level at which the metal is heat treated in accordance with the procedure set forth below.

The bed is now gently fluidized, thereby turning the environment surrounding each of the castings into a highly heat-conductive medium. Fluidizing a sand bed causes the bed to be a very good conductor of heat. This should be kept in mind during the following discussion. For example, a casting in a fluidized sand bed will cool with extreme speed provided the sand itself is cooler than the casting and remains cooler because of its relatively large mass or because of external cooling. A casting in a sand bed will cool faster than it would in open air, possibly even 5 to 20 times faster. Futhermore, a casting also gains heat much faster in a heated fluidized bed than it does in an ordinary air furnace or than it would being heated in the open with a torch.

Fluidizing the bed causes rapid heat flow away from the casting and an even distribution of heat throughout the bed. The rapid quenching naturally caused by the bed can be further enhanced and accelerated by spraying water on the bed or by the application of steam through valving means 18 from a steam source 26 connected to valving means 18 to be combined with the fluidizing gas supply. It should be noted that although the bed achieves a nearly uniform temperature throughout while it is fluidized, the casting is cooled more quickly on the outside than on the inside since the flow of heat from the center of the casting to the exterior is much slower than the flow of heat from the exterior of the casting through the fluidized bed.

The fluidizing of the bed is suspended while the casting is somewhat above the desired initial heat treating temperature. Suspension of fluidizing converts the bed from an excellent heat conductor to an excellent insulator. The exterior of the casting will continue to cool only until the adjacent sand is heated to the same temperature, which occurs very quickly. Now the temperature in the casting stabilizes since the flow from the inside of the casting to the outside is much faster than the flow of heat from the exterior of the casting through the defluidized bed. The casting temperature becomes nearly uniform throughout and then will very slowly cool at a rate determined by the cooling of the overall bed.

When the casting temperature stabilizes, it is possible to again fluidize the bed, and repeat the rapid quenching of the casting to a lower level, using auxiliary quenching steam or sprayed-on water, as desired, as discussed above. Again, the fluidizing is suspended and the casting allowed to stabilize at the lower temperature.

After the final heat treating cycle, each cycle normally only requiring fluidizing and no additional heating of the bed, the bed is again fluidized to permit removal of the casting from the bed.

In the event that the casting needs to be heated above the level to which it has then cooled, heat can be supplied to the bed by auxiliary heating means. One such means is a gas-fired heater comprising a gas source 30 connected to a pipe 32 having a plurality of downwardly directed gas jets. Desirably the pipe is located about 1"-2" above the surface of sand 12, although locating the pipe an inch or two below the surface is also acceptable. Other heating means, such as embedded electrical resistance coils or such as induction coils surrounding the bed around the inside periphery of box 10, can be used for supplying heat to the sand.

It may be that the bed, and therefore the embedded casting or castings are too hot for immediate use after the last heat treating step. In addition to water spraying or the injection of steam, it is also convenient to embed pipes in the sand for carrying cooling fluid, thereby achieving the desired cooling result.

The heat treatment process whereby the casting is cooled in steps is referred to as "austempering" or "interrupted quenching". The desired properties are predictable from a time-temperature transformation (TTT) curve for the selected alloy. Hence, as may be seen by referring to FIG. 2, a typical TTT curve, the dash line treatment achieved by the foregoing approximates the theoretical optimum heat treatment reflected by the solid lines on the chart.

Besides heat treating the casting in a very desirable manner, the process described above also has resulted in nearly complete reclamation of the sand by burning off any resins or styrene particles or residue remaining after the casting. For example, it should be noted that loose particles different in weight or size than the sand, such as bits of resin-bonded sand or partially oxidized pattern material remaining in the bed, will generally rise or float to permit scooping off during the fluidizing or they will descend to the bottom where they are harmless.

It has been observed that the fluidized bed forms an excellent insulation at rest. A casting surrounded by still sand holds its heat for long lengths of time. A 300-pound casting, for example, cools as little as 25-50 degrees per hour under a bed of still sand. Nevertheless, as noted previously, it may be desirable to heat the bed to raise the temperature in the casting or to hold it at a uniform level for an extended period of time. In addition to the illustrated gas-fired heater using a heating coil or coils or using induction heating means, other methods may be used for adding heat to the fluidized bed. For example, it is possible to mix gas with the fluidized air and light the gas so as to cause burning at the surface and throughout the bed. It is also possible to pass a carbon-rich mixture of gas with the air which is just below the combustion level, which can be ignited at the surface with the addition of air or oxygen. The produces a heating at the surface only and prevents oxidation of the casting with the liberated carbon.

Finally, an inert gas, such as argon, can be added to the fluidizing supply to shield both oxygen-rich gas and carbon-rich gas from the casting surface. While a particular embodiment of the invention has been shown and described, it will be understood that the invention is not limited thereto, since many modifications may be made and will become apparent to those skilled in the art. For example, a casting could be removed from the actual sand in which it was produced to another similar box for the heat treating steps as described hereinabove, if desired.

What is claimed is:

1. The foundry process, which comprises the steps of producing a thin shell, slightly porous mold, fluidizing a mold bed of granular material and setting the thin shell mold therein, said fluidizing being created by a pressure differential upward through the bed, discontinuing the fluidizing step to permit the granular material of the mold bed to solidify about the thin shell mold, thereby settling the mold into the mold bed, pouring molten metal from a foundry furnace into the shell mold to form a casting while creating a pressure differential downward through the bed, the pressure differential assuring mold structure integrity, assisting in the uniform and complete flow of molten metal in the mold and causing the downward extraction of combustible gases, heat treating the formed casting at a first high temperature while creating an upward pressure differential through the bed, said pressure differential gently fluidizing the bed, thereby uniformly heat treating the casting, cooling said bed while creating an upward pressure differential through the bed using ordinary air, thereby heat treating the formed casting at a lower temperature than said first temperature, heat treating the formed casting at a second high temperature lower than the first high temperature while again gently fluidizing the bed around the casting by creating an upward pressure differential through the bed, cooling the casting to about room temperature, and gently fluidizing the bed of granular material and removing the casting.

2. The foundry process in accordance with claim 1, wherein at least some combustible gas is directed upward through the bed while the heated bed is fluidized, said gases combusting in combination with environmental oxygen at the elevated temperature to add heat to the bed.

3. The foundry process in accordance with claim 1, wherein said heat treating includes resistance heating.

4. The foundry process in accordance with claim 1, wherein said heat treating includes induction heating.

5. The foundry process in accordance with claim 1, wherein said heat treating includes adding heat via a gas air burner located in close proximity to the surface of the bed.

6. The foundry process in accordance with claim 1, wherein a rich mixture of air and carbon combustible gaseous products below the combusting level is directed upward through the bed for fluidizing the bed, additional air is added at the surface of the bed and the surface level is ignited for heating the surface of the bed without causing combustion to occur through the bed.

7. The foundry process in accordance with claim 1, wherein fluidizing is imparted to the bed using an inert gas.

8. The foundry process in accordance with claim 7, wherein the inert gas is argon.

9. The foundry process in accordance with claim 1, wherein said thin shell mold is made from a combination of sand and binders.

10. A foundry process in accordance with claim 1, wherein a pattern is made of styrene as an initial step in producing the thin shell, the stryrene pattern maintained within the thin shell mold until it is vaporized by the pouring of molten metal into the mold, the downward pressure differential retaining the shape of the mold after the styrene vaporizes and before the molten metal fills the mold.

11. The foundry process in accordance with claim 10, and including increasing the downward flow of air during the pouring of the molten metal thereby forcing air to flow through the mold wall adjacent the hot metal and preventing the expanding gases from the vaporizing styrene from distorting the mold.

12. The foundry process in accordance with claim 10, whereby the increasing of the downward flow of air is accomplished by a vacuum pump and an accumulator tank.

13. The foundry process in accordance with claim 1, wherein the combustion occurring during said heat treating steps reclaims the bed material for reuse.

14. The foundry process in accordance with claim 1, wherein the mold bed is fluidized through a permeable membrane.

15. The foundry process in accordance with claim 1, wherein the granular material of the mold bed is sand.

16. The foundry process in accordance with claim 15, wherein the particle size of the sand is in the 30–120 mesh range.

17. The foundry process in accordance with claim 15, wherein the particle size of the sand is a nominal 80 mesh.

18. The foundry process in accordance with claim 1, wherein fluidizing of the mold bed is established with an upward pressure differential of about one psi per foot of depth of the bed.

19. The foundry process in accordance with claim 18, wherein the upward air flow established by the pressure differential is between 3 and 30 feet per minute.

20. The foundry process in accordance with claim 16, wherein the particle size of the sand is a nominal 30 mesh and the upward air flow established by the pressure differential is about 100 feet per minute.

21. The foundry process in accordance with claim 1, wherein the steps of heat treating are each for a duration of from about 5 to 20 minutes.

22. The foundry process in accordance with claim 1, and including the step of placing a removable understructure in location beneath the thin shell mold, said understructure having passages therethrough to prevent undue hindrance to the upward flow of air through the bed.

23. The foundry process in accordance with claim 1 and including the step of heating and drying the charged materials for the foundry furnace with heat developed in the heat treating steps.

24. The foundry process in accordance with claim 1, and including the step of covering the mold bed prior to said pouring step to increase the vacuum within said thin shell mold caused by the established downward pressure differential, thereby concentrating air flow through the mold.

25. The foundry process in accordance with claim 1, and including a plurality of subsequent cooling with heat treating steps following the second-named heat treating step, each subsequent heat treating step being at a lower high temperature than the preceding heat treating step.

26. The foundry process in accordance with claim 1, wherein said first heat treating temperature is slightly above a first desirable temperature for the formed casting, and including the step of suspending fluidizing and heat treating before said cooling step the casting giving off some heat to the adjacent granular material until the temperature lowers and stabilizes throughout the casting at the desirable temperature, the defluidized granular material acting as an insulator.

27. The foundry process in accordance with claim 1, wherein water is sprayed on the bed during said cooling step.

28. The foundry process in accordance with claim 1, wherein cooling is provided by coils embedded in the bed carrying circulating cooling fluid therethrough.

* * * * *